US006692584B2

(12) United States Patent
Sakata et al.

(10) Patent No.: US 6,692,584 B2
(45) Date of Patent: Feb. 17, 2004

(54) HIGH TENSILE COLD-ROLLED STEEL SHEET EXCELLENT IN DUCTILITY AND IN STRAIN AGING HARDENING PROPERTIES, AND METHOD FOR PRODUCING THE SAME

(75) Inventors: Kei Sakata, Chiba (JP); Akio Tosaka, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/009,957

(22) PCT Filed: Feb. 14, 2001

(86) PCT No.: PCT/JP01/01006

§ 371 (c)(1),
(2), (4) Date: Dec. 12, 2001

(87) PCT Pub. No.: WO01/83839

PCT Pub. Date: Nov. 8, 2001

(65) Prior Publication Data

US 2003/0047258 A1 Mar. 13, 2003

(30) Foreign Application Priority Data

Apr. 27, 2000 (JP) ..... 2000-127705

(51) Int. Cl.[7] ..... C22C 38/06; C22C 38/12; C22C 38/14; C22C 38/18; C21D 9/00; C21D 8/00

(52) U.S. Cl. ..... 148/320; 148/330; 148/332; 148/333; 148/336; 148/603; 148/652

(58) Field of Search ..... 148/320, 330, 148/332, 333, 336, 603, 652

(56) References Cited

U.S. PATENT DOCUMENTS

| | | | | |
|---|---|---|---|---|
| 4,854,976 A | * | 8/1989 | Era et al. | 148/320 |
| 5,328,528 A | | 7/1994 | Chen | |
| 6,425,963 B1 | * | 7/2002 | Kaneko et al. | 148/320 |

FOREIGN PATENT DOCUMENTS

| | | |
|---|---|---|
| EP | 0 922 777 A1 | 6/1999 |
| EP | 0 922 782 A1 | 6/1999 |
| EP | 0 952 235 A1 | 10/1999 |
| EP | 0 974 677 A1 | 1/2000 |
| JP | 04074824 | 3/1992 |
| JP | 04333524 | 11/1992 |

* cited by examiner

*Primary Examiner*—Deborah Yee
(74) *Attorney, Agent, or Firm*—Piper Rudnick LLP

(57) ABSTRACT

The present invention provides a high tensile cold-rolled steel sheet having superior ductility, strain age-hardening characteristics, and crash resistance properties, and also provides a manufacturing method therefor. As a particular means, a thin cold-rolled steel sheet containing 0.05% to 0.30% of C, 0.4% to 2.0% of Si, 0.7% to 3.0% of Mn, 0.08% or less of P, 0.02% or less of Al, and 0.0050% to 0.0250% of N on a mass % basis is manufactured in which N/Al is 0.3 or more. This thin cold-rolled steel sheet is heated to a temperature between (an $Ac_1$ transformation point) and (an $Ac_3$ transformation point+50° C.), is cooled at a cooling rate of 5 to 150° C./second in the range of at least 600 to 500° C., and is held in the temperature range of 350 to 500° C. This steel sheet has superior ductility, strain age-hardening characteristics having a ΔTS of 50 MPa or more, and crash resistance properties.

5 Claims, No Drawings

HIGH TENSILE COLD-ROLLED STEEL SHEET EXCELLENT IN DUCTILITY AND IN STRAIN AGING HARDENING PROPERTIES, AND METHOD FOR PRODUCING THE SAME

RELATED APLLICATIONS

This application is a 371 of PCT/JP01/01006 filed Feb. 14, 2001, which claims benefit from Japanese Application No. 2000-127705 filed Apr. 27, 2000.

TECHNICAL FIELD

The present invention relates to high tensile cold-rolled steel sheets which have superior workability and are steel sheets suitably and primarily used for automobile bodies. In particular the present invention relates to a high tensile cold-rolled steel sheet having a tensile strength (TS) of 440 MPa or more, and superior ductility and strain age-hardening characteristics, and relates to a manufacturing method therefor. The high tensile cold-rolled steel sheet of the present invention is suitably used for various applications from relatively light fabrications, such as simple bending or pipe formation by roll forming, to relatively complicated drawing. In the present invention, the steel sheet includes a steel strip in coil form.

In addition, in the present invention, "superior strain age-hardening characteristics" mean that when aging treatment is performed under the conditions of a temperature of 170° C. and a holding time of 20 minutes after a predeformation of a 5%-tensile strain, an increased amount (hereinafter referred to as "BH amount"; BH amount=yield stress after aging treatment−predeformation stress before aging treatment) of deformation stress before and after this aging treatment is 80 MPa or more, and that an increase amount (hereinafter referred to as "ΔTS"; ΔTS=tensile strength after ageing treatment−tensile strength before predeformation) of tensile strength before and after strain aging treatment (the predeformation+the aging treatment described above) is 50 MPa or more.

BACKGROUND ART

Due to recent emission gas restrictions associated with global environmental conservation measures, reduction in body weight of automobiles has become a very important subject. In order to reduce the body weight of automobiles, it is effective to increase the strength of steel sheets which are used in a large quantity, that is, it is effective to decrease the thickness of the steel sheets by using high tensile steel sheets.

However, automobile parts which are formed of thin high tensile steel sheets must fully satisfy its performance imposed thereon in accordance with its role. As the performances mentioned above, for example, static strengths against bending or resilient deformation, fatigue resistance, or crash resistance properties may be mentioned. Accordingly, high tensile steel sheets used for automobile parts must also have superior properties after press forming and fabrication.

In addition, press forming is performed for steel sheets in a process for manufacturing automobile parts, and when press forming is performed for a steel sheet having an excessively high strength, a problem may arise in that, (1) shape freezing properties are degraded, or (2) defects such as cracking or necking occur during press forming due to a decrease in ductility.

As a result, high tensile steel sheets have not been widely used for automobile bodies.

In order to overcome the problems described above, for example, as a cold-rolled steel sheet for forming exterior panels, a steel sheet which is formed of an extremely low carbon steel sheet and which finally contains carbon in a solid-solution state at a concentration in an appropriately controlled range has been well known. This type of steel sheet maintains its softness during press forming and also ensures the shape-freezing properties and ductility, and in addition, this steel sheet is formed to ensure dent resistance by an increase in yield stress using a strain age-hardening phenomenon which occurs during a paint baking step performed at approximately 170° C. for 20 minutes after press forming. This type of steel sheet has the softness since carbon is solute therein during press forming, and during a paint baking step performed after the press forming, the solute carbon is fixed at dislocations formed during the press forming, whereby the yield stress is increased.

However, in this type of steel sheet, in order to prevent the generation of stretcher strain which may form surface defects, the increase of yield stress caused by strain age-hardening is suppressed to a lower level. Accordingly, the reduction in weight of parts is not significant in practice.

That is, the reduction in weight of parts cannot be sufficiently performed only by the increase in yield stress caused by strain ageing, and an increase in strength properties is necessary when deformation further occurs. In other words, an increase in tensile strength after strain aging is necessary.

On the other hand, in applications in which the appearances are not so important, a steel sheet containing a further increased bake hardening amount using solute N or a steel sheet having further improved bake hardening property by forming a composite structure composed of ferrite and martensite has been proposed.

For example, Japanese Unexamined Patent Application Publication No. 60-52528 disclosed a method for manufacturing a high-tensile thin steel sheet having superior ductility and spot weldability by the steps of performing hot rolling of a steel containing 0.02% to 0.15% of C, 0.8% to 3.5% of Mn, 0.02% to 0.15% of P, 0.10% or less of Al, and 0.005% to 0.025% of N at a temperature of 550° C. or less, and performing annealing after cold rolling by controlled cooling heat treatment. A steel sheet manufactured by a method disclosed in Japanese Unexamined Patent Application Publication No. 60-52528 is a steel sheet having a composite structure formed of cold-transformed product phases primarily composed of ferrite and martensite and having superior ductility, and in addition, the steel sheet is formed to obtain a high strength by using strain aging during paint baking caused by N which is intentionally added.

According to the technique disclosed in Japanese Unexamined Patent Application Publication No. 60-52528, the increase in the yield stress (YS) by strain age-hardening is large; however, the increase in the tensile strength (TS) is small. In addition, since the mechanical properties considerably vary, for example, since the increase in the yield stress (YS) considerably varies, the thickness of the steel sheet cannot be reduced to a level at which the current requirement of weight reduction can be satisfied.

In addition, a so-called transformation induced plasticity type steel sheet having a composite structure composed of ferrite, bainite, and residual austenite and having significantly improved ductility has also been proposed.

For example, Japanese Unexamined Patent Application Publication No. 61-217529 disclosed a method for manufacturing a high tensile steel sheet having superior ductility by annealing a steel sheet composed of 0.12% to 0.70% of C, 0.4% to 1.8% of Si, 0.2% to 2.5% of Mn, 0.01% to 0.07% of Al, 0.02% or less of N, and the balance of Fe and unavoidable impurities under controlled continuous annealing conditions. However, the steel sheet produced by the technique described in Japanese Unexamined Patent Application Publication No. 61-217529 improves its ductility by precipitating N in the form of AlN using Al and does not substantially contain an interstitial element such as C or N. Accordingly, the strength is not substantially improved by paint baking treatment which is performed after press forming. Consequently, since the strength of the finished product is extremely low, there has been a problem in that the steel sheet described above cannot be used for an application in which crash resistance properties are strongly required. In addition, the steel sheet produced by the technique described in Japanese Unexamined Patent Application Publication No. 61-217529 contains Si, Mn, or the like at a higher concentration compared to a steel sheet having the same strength, and hence, the paintability and weldability are inferior.

In view of improving safety for passengers, a steel sheet having superior workability and crash resistance properties has been desired. That is, a steel which is soft and has superior workability in press forming and which has yield stress and tensile strength, both increased by heat treatment such as paint baking treatment after fabrication so as to increase strengths of parts, has been desired.

In response to the desires described above, for example, Japanese Unexamined Patent Application Publication Nos. 10-310824 and 10-310847 disclosed an alloyed molten zinc-plated steel sheet having a mechanical strength property increased by heat treatment after forming and a manufacturing method therefor. The steel sheet described above contains 0.01% to 0.08% of C, 0.005% to 1.0% of Si, 0.01% to 3.0% of Mn, 0.001% to 0.1% of Al, 0.0002% to 0.01% of N, and 0.05% to 3.0% of the total of at least one of W, Cr, and Mo, and has a structure composed of ferrite or a structure primarily composed of ferrite. The above-mentioned mechanical strength property increased by heat treatment after forming means a property in which a steel sheet formed by a forming step with an application of 2% or more strain followed by heat treatment at 200 to 450° C. has an increased tensile strength compared to the tensile strength obtained before the heat treatment. However, for the steel sheets formed by the techniques described in Japanese Unexamined Patent Application Publication Nos. 10-310824 and 10-310847, paint baking treatment must be performed at a temperature of 200 to 450° C. which is higher than a conventional temperature (170° C.), and hence, there has been a problem of economic disadvantage due to decrease in productivity of part production.

In addition, the conventional steel sheets described above have superior tensile strength measured by a simple tensile test performed after the paint baking treatment; however, when plastic deformation occurs in accordance with actual pressing conditions, the strength considerably varies, and as a result, the conventional steel sheets cannot be always applied to the parts which require reliability.

Accordingly, an object of the present invention is to provide a high tensile cold-rolled steel sheet which can solve the problems of the conventional techniques. The high tensile steel sheet described above has high ductility, superior strain age-hardening characteristics for increasing the strength, after automobile parts are formed, sufficient to reduce the weight of the automobile body, and superior crash resistant properties. In addition, the present invention also provides a method for reliably performing a mass production of the steel sheet described above at a lower cost. The strain age-hardening characteristics of the present invention are to obtain a BH amount of 80 MPa or more and a ΔTS of 50 MPa or more under the conditions of a predeformation of 5%-tensile strain, a temperature of 170° C., and a holding time of 20 minutes.

DISCLOSURE OF INVENTION

To these ends, the inventors of the present invention carried out experiments for material evaluation using steel sheets having various compositions and formed under various conditions. As a result, it was discovered that improvement in press formability and increase in strength after press forming could be easily achieved by using N as an enhancing element, which had not been positively used for applications in which superior workability is required, so that elements which form alloys are decreased, and by advantageously using a significant strain age-hardening phenomenon generated by the function of this enhancing element (N).

In addition, the inventors of the present invention discovered that, by controlling annealing conditions, including heating and cooling conditions, for a cold-rolled steel sheet, a composite structure composed of ferrite, bainite, and residual austenite could be formed, the ductility could be significantly improved, and press formability was improved. In addition, the inventors also discovered that by the control of the annealing condition described above, the amount of solute N could be controlled in an appropriate range, the strain age-hardening phenomenon caused by N could be advantageously used, and crash resistance properties of automobile parts could be significantly improved.

Further intensive research was conducted based on the discoveries described above, and as a result, the present invention was made. That is, a first aspect of the present invention is a high tensile cold-rolled steel sheet which has superior ductility and strain age-hardening characteristics having a ΔTS of 50 MPa or more. This high tensile cold-rolled steel sheet has a composition comprising, on a mass % basis, 0.05% to 0.30% of C, 0.4% to 2.0% of Si, 0.7% to 3.0% of Mn, 0.08% or less of P, 0.02% or less of Al, and 0.0050% to 0.0250% of N, wherein N/Al is 0.3 or more, N in a solid-solution state is contained at a concentration of 0.0010% or more, and the balance is Fe and unavoidable impurities. In addition, this high tensile cold-rolled steel sheet has a composite structure containing 20% to 80% of a ferrite phase, 10% to 60% of a bainite phase, and 3.0% or more of a residual austenite phase on a mass % basis. In the first aspect of the present invention, in addition to the composition described above, it is preferable that at least one of the following a to c groups on a mass % basis be further contained, in which

- the a group contains at least one of 0.0003% to 0.01% of B, 0.005% to 1.5% of Cu, 0.005% to 1.5% of Ni, and 0.05% to 1.0% of Cr,
- the b group contains at least one of Ti, Nb, V, and Zr at a total content of 0.002% to 0.03%, and
- the c group contains at least one of Ca and REM at a total content of 0.0010% to 0.010%.

In addition, in the first aspect of the present invention, the thickness of the high tensile cold-rolled steel sheet is preferably a thin steel sheet having a thickness of 3.2 mm or less.

In addition, a second aspect of the present invention is a method for manufacturing a high tensile cold-rolled steel sheet which has superior ductility and strain age-hardening characteristics having a ΔTS of 50 MPa or more. The method described above comprises an annealing step of annealing a thin cold-rolled steel sheet containing, on a mass % basis, 0.05% to 0.30% of C, 0.4% to 2.0% of Si, 0.7% to 3.0% of Mn, 0.08% or less of P, 0.02% or less of Al, and 0.0050% to 0.0250% of N, wherein N/Al is 0.3 or more, at a heating temperature between (an $Ac_1$ transformation point) and (an $Ac_3$ transformation point+50° C.); and a cooling/holding step for cooling the steel sheet from the heating temperature at a cooling rate of 5 to 150° C./second in the range of at least 600 to 500° C. and for holding the steel sheet for 30 seconds or more in the temperature range of 350 to 500° C.

BEST MODE FOR CARRYING OUT THE INVENTION

First, the reasons for limiting the composition of the steel sheet of the present invention will be described. In the present invention, mass % will be simply represented by %.

C: 0.05% to 0.25%

C is an element for increasing strength of a steel sheet and is concentrated in an austenite phase (γ) so as to stabilize the γ phase, and in the present invention, the content thereof must be 0.05% or more in order to ensure a desired amount of residual γ. On the other hand, when the content is more than 0.25%, the weldability is extremely degraded. Accordingly, the content of C is limited in the range of 0.05% to 0.25%. In order to obtain significantly superior ductility and weldability at the same time, the content is preferably in the range of 0.07% to 0.18%.

Si: 0.4% to 2.0%

Si is an effective element for increasing strength of a steel sheet without significantly decreasing the ductility of the steel and, in addition, is an element having the effect of increasing the stability of untransformed γ by suppressing the formation of carbide materials when the γ is transformed into bainite. The effect described above can be observed when the content is 0.4% or more. On the other hand, when the content is more than 2.0%, the effect is saturated, and in addition, surface characteristics such as surface conditions or processability by chemical conversion treatment are adversely affected. Accordingly, the content of Si is limited in the range of 0.4% to 2.0%. In addition, the content is preferably in the range of 0.6% to 1.5%.

Mn: 0.5% to 3.0%

Mn is an element for improving the bake hardening property and greatly contributes to an increase in strength of a steel sheet. In addition, Mn is an effective element for preventing hot cracking caused by S and is preferably added corresponding to the amount of S contained. In addition, by being concentrated in the γ phase, Mn improves the bake hardening property and has the effect of stabilizing the residual γ. This effect can be observed when the content is 0.5% or more; however, when the content is more than 3.0%, the effects described above are saturated, and the spot weldability is considerably degraded. As a result, the content of Mn is limited in the range of 0.5% to 3.0%. In addition, the content is preferably in the range of 0.9% to 2.0%.

P: 0.08% or less

P is an effective element for promoting the formation of a solid solution of a steel sheet and for improving the ductility or the r value(Lankford value); however, when P is excessively contained, the steel becomes brittle, and hence, extended flange workability of the steel is degraded. In addition, P is very likely to localize in steel, and hence, welded parts may become brittle due to the localization thereof. Accordingly, the content of P is limited to 0.08% or less. In the case in which the extended flange workability and the toughness of a welded portion are specifically important, the content is preferably set to 0.04% or less. In view of the toughness of a welded portion, the content is more preferably 0.02% or less.

Al: 0.02% or less

Al is an effective element that serves as an oxidizer to improve the cleanliness of steel when an ingot is formed and that also promotes the formation of a finer steel structure, and hence, the content is preferably 0.005% or more in the present invention. On the other hand, an excessively high content of Al degrades the cleanliness of the surface of a steel sheet and, in addition, decreases N in a solid-solution state. Consequently, the solute N, which contributes to the strain age-hardening phenomenon, becomes deficient, and hence, the strain age-hardening characteristics, which are the advantage of the present invention, are degraded. Accordingly, the content of Al is set to be low such as 0.02% or less. In order to reliably obtain superior strain age-hardening characteristics, the content is preferably 0.015% or less.

N: 0.0050% to 0.0250%

N is the most important element of the present invention. In the present invention, by controlling manufacturing conditions while an appropriate amount of N is contained, the amount of N in a solid-solution state, which is necessary and sufficient for a cold-rolled product, is ensured. Accordingly, the effect of increasing strengths (YS and TS) obtained by promoting the formation of a solid solution and the strain age-hardening can be fully obtained, and as a result, the requirement of mechanical properties of the present invention, that is, a TS of 440 MPa or more, a BH amount of 80 MPa or more, and an increased tensile strength ΔTS of 50 MPa or more before and after strain aging treatment, can be reliably satisfied. Accordingly, the crash resistance and the fatigue resistance properties of finished products (parts) can also be improved. In addition, by using the effect of increasing the strength obtained by solute N, the amount of added C, Si, Mn, or the like can be decreased, and hence, degradation of the weldability and paintability can be prevented.

When the content of N is less than 0.0050%, the effect of increasing strength described above is difficult to reliably obtain. On the other hand, when the content of N is more than 0.0250%, the rate of generation of internal defects in a steel sheet becomes high, and cracking of slabs or the like frequently occurs. Accordingly, the content of N is limited to 0.0050% to 0.0250%. In addition, in order to maintain the stability of material qualities and to increase the production yield in consideration of the overall manufacturing process, the content of N is more preferably in the range of 0.0070% to 0.0170%. When the content of N is in the range of the present invention, the weldability such as spot weldability or arc-weldability is not adversely affected.

N in Solid-Solution State: 0.0010% or more

In order to ensure sufficient strengths of a cold-rolled product by promoting the formation of a solid solution and to satisfactory obtain the strain age-hardening effect by the presence of N, N in a solid-solution state (solute N) contained in steel must be present in a content (concentration) of 0.0010% or more.

In the present invention, the amount of solute N is obtained by deducting the amount of precipitated N from the total amount of N in the steel. As an analytical method for analyzing the amount of precipitated N, through intensive research by the inventors of the present invention on various analytical methods, it was found that an electrolytic extraction analytical method using a constant-potential electrolytic method was effectively used. In addition, as a method for melting base iron, which is used for the extraction analysis, an acid decomposing method, a halogenation method, or an electrolytic method may be mentioned. Among the above methods, the electrolytic method is most preferably used since base iron can only be melted stably without decomposing extremely unstable precipitated materials such as carbides or nitrides. Electrolysis is performed at a constant potential using an acetylacetone-based solution as an electrolyte. In the present invention, the result of the amount of precipitated N measured by using a constant-potential electrolytic method showed the best correspondence to the actual strength of the finished part.

As described above, in the present invention, a residue extracted by a constant-potential electrolytic method is chemically decomposed so as to obtain the amount of N in the residue, and this amount of N is used as the amount of precipitated N.

In addition, in order to obtain higher BH amount and ΔTS, the amount of solute N is 0.0020% or more, and in order to obtain even higher values, the content is preferably set to 0.0030% or more.

N/Al (the Ratio of N Content to Al Content): 0.3 or more

In order to stably contain 0.0010% or more of solute N in a final product, the amount of Al that is an element strongly fixing N must be limited. According to the results obtained by widely changing the combinations of the N contents and the Al contents within the ranges of the present invention, it was found that in order to contain 0.0010% or more of the solute N in a cold-rolled product so as to obtain superior strain age-hardening characteristics, the ratio N/Al must be 0.3 or more when the amount of Al is set to be low such as 0.02% or less. That is, the content of Al is limited to (N content)/0.3 or less. In addition to the compositions described above, when necessary, the steel sheet according to the present invention preferably contains at least one group selected from the following a to c groups.

The a group contains at least one of 0.0003% to 0.01% of B, 0.005% to 1.5% of Cu, 0.005% to 1.5% of Ni, and 0.05% to 1.0% of Cr;

the b group contains at least one of Ti, Nb, V and Zr at the total content of 0.002% to 0.03%; and the c group contains at least one of Ca and REM at the total content of 0.0010% to 0.010%.

The a group: At least one of 0.0003% to 0.01% of B, 0.005% to 1.5% of Cu, 0.005% to 1.5% of Ni, and 0.05% to 1.0% of Cr All of the elements of the a group, B, Cu, Ni, and Cr, are elements which improve the bake hardening property as Mn does, and when necessary, at least one of the elements may be selectively contained.

B is an effective element which improves the bake hardening property and also improves the ductility, and the above-mentioned effects can be observed when the content is 0.0003% or more. On the hand, when the content is more than 0.01%, B is precipitated, and hence, the workability is degraded. Accordingly, the content of B is preferably limited to 0.0003% to 0.01%.

Cu is an element which improves the bake hardening property and also increases the strength of a steel sheet, and the above-mentioned effects can be observed when the content is 0.05% or more. When the content is more than 1.5%, scale defects frequently occur during hot rolling. Accordingly, the content of Cu is preferably 0.05% to 1.5%.

Since Ni is an element which improves the bake hardening property and also increases the strength of a steel sheet. In addition, since Ni may not seriously degrade the platability of a steel sheet, it may be contained when necessary. The above-mentioned effects can be observed when the content is 0.005% or more. However, when the content is more than 1.5%, the strength is so much increased that the ductility is degraded, and as a result, the workability in press forming is degraded. Accordingly, the content of Ni is preferably 0.005% to 1.5%.

Cr is an element which improves the bake hardening property and increases the strength of a steel sheet, and also has the effects of finely dispersing the residual γ and of improving the ductility. The above-mentioned effects can be observed when the content is 0.05% or more. On the other hand, when the content is more than 1.0%, wettability with a plating layer is degraded. Accordingly, the content of Cr is preferably 0.05% to 1.0%.

The b group: At least one of Ti, Nb, V, and Zr at the total content of 0.002% to 0.03%

All of the elements of the b group are elements which allow crystal particles to be finer and have the effect of improving the ductility, and when necessary, at least one of them may be selectively contained. However, when the content is excessive, the amount of N in a solid-solution state is decreased. Accordingly, at least one of Ti, Nb, V, and Zr is preferably contained at a total content of 0.002% to 0.03%.

The c group: At least one of Ca and REM at a total content of 0.0010% to 0.010%

All of the elements of the c group, Ca and REM, are effective elements for controlling the form of inclusions, and in particular, when the extended flange workability is required, they are preferably contained alone or in combination. In the case described above, when the total content of the elements of the c group is less than 0.0010%, the effect of controlling the from of inclusions is deficient, and on the other hand, when the content is more than 0.010%, the generation of surface defects frequently occurs. Accordingly, the total content of the elements of the c group is preferably limited to 0.0010% to 0.010%.

The balance other than the components described above are Fe and unavoidable impurities. As the unavoidable impurities, 0.02% or less of S may be contained.

S is present in a steel sheet as an inclusion and is an element degrading the ductility and corrosion resistance of the steel sheet, and hence, the content thereof is preferably reduced as small as possible. In an application in which superior workability is particularly required, the content is preferably 0.015% or less, and when the level of requirement of extended flange workability is high, the content of S is preferably decreased to 0.008% or less. In order to stably maintain the strain age-hardening characteristics at a high level, the content of S is preferably decreased to 0.008% or less even though the detailed mechanism has not been understood.

Next, the structure of the steel sheet of the present invention will be described.

Volume Fraction of Ferrite Phase: 20% to 80%

The cold-rolled steel sheet of the present invention is formed as a steel sheet used for automobile applications or the like which require superior workability, and in order to ensure the ductility, the structure of the steel sheet contains 20 to 80% of a ferrite phase on a volume fraction basis. When the volume fraction of the ferrite phase is less than 20%, it is difficult to ensure the ductility necessary for the steel sheet used for automobile applications which require superior workability. When superior ductility is required, the volume fraction of the ferrite phase is preferably set to 30% or more. On the other hand, when the volume fraction of the ferrite is more than 80%, the advantages of the composite structure are reduced. Accordingly, the volume fraction of the ferrite phase is set to 20% to 80%.

Volume Fraction of Bainite Phase: 10% to 60%

The cold-rolled steel sheet of the present invention is formed as a high tensile steel sheet used for automobile applications or the like which require superior workability, and in order to ensure superior combination of the ductility and the strength, in addition to the ferrite phase, the structure further contains 10 to 60% of a bainite phase. When the volume fraction of the bainite phase is less than 10%, it is difficult to ensure necessary ductility and strength. When even more superior ductility is required, the volume fraction of the bainite phase is preferably set to 15% or more. On the other hand, when the volume fraction of the bainite phase is more than 60%, the ductility is considerably decreased. Accordingly, the volume fraction of the bainite phase is set to 10% to 60%.

Volume Fraction of Residual Austenite Phase: 3.0% or more

The cold-rolled steel sheet of the present invention contains 3.0% or more of a residual austenite (γ) phase on a volume fraction basis in order to ensure superior ductility. Accordingly, an elongation of 35% or more and an elongation of 30% or more can be ensured for a steel sheet having a tensile strength level of 590 MPa and a steel sheet having a tensile strength level of 780 MPa, respectively. The upper limit of the volume of the residual γ phase is not specifically limited; however, it is believed that approximately 15% is substantially the upper limit. In the present invention, when a large amount of N is contained and is present in a solid-solution state, the amount of residual γ can be very stably ensured.

In addition, as a phase other than the phases described above, a small volume (10% or less) of a martensite phase may be contained.

The cold-rolled steel sheet having the composition and the structure described above according to the present invention is a cold-rolled steel sheet which has a tensile strength TS of 440 MPa or more, superior ductility, and superior strain age-hardening characteristics, and after press forming and paint baking treatment, the yield stress and the tensile stress of the steel sheet are increased, so that a finished product having superior crash resistance properties can be obtained.

When the strain age-hardening characteristics are defined, a prestrain (predeformation) amount is an important factor. The inventors of the present invention made research on the influence of the prestrain amount on the strain age-hardening characteristics in consideration of a deformation mode applied to a steel sheet used for automobiles, and as a result, the inventors discovered that (1) the deformation stress in the above-mentioned deformation mode could be understood approximately by using an equivalent uniaxial strain (tensile strain) in many cases other than the case of deep drawing, (2) this equivalent uniaxial strain of an actual part is approximately more than 5%, and (3) the strength of a part had good correspondence to the strength (YS or TS) obtained after strain age-hardening treatment at a prestrain of 5%. Based on these discoveries, in the present invention, the predeformation of strain age-hardening treatment is set to a tensile strain of 5%.

In conventional paint baking treatment, conditions at a temperature of 170° C. for 20 minutes are used as the standard conditions. When a strain of 5% or more is applied to the steel sheet of the present invention, which contains a large amount of solute N, hardening can be achieved by even milder (lower temperature) treatment, in other words, aging conditions can be further widened. In general, in order to obtain increased amounts caused by hardening, hardening treatment is advantageously performed at a higher temperature and for a longer time as long as the steel sheet is not softened by excessive aging.

In more particular, in the steel sheet of the present invention, a lower limit of a heating temperature at which hardening significantly occurs after predeformation is approximately 100° C. On the other hand, when the heating temperature is more than 300° C., the hardening does not proceed. When the heating temperature is more than 400° C., softening adversely tends to occur, and the generations of heat strains and temper color become distinct. In addition, concerning the holding time, when the heating temperature is approximately 200° C., approximately sufficient hardening can be performed for about 30 seconds. Furthermore, in order to obtain even more stable hardening, the holding time is preferably set to 60 seconds or more. However, when the holding time is more than 20 minutes, further hardening cannot be expected, and in addition, this holding time cannot be used in practice since the productivity is significantly decreased.

As described above, in the present invention, evaluation will be performed under the conditions of a heating temperature of 170° C. and a holding time of 20 minutes, which are the conventional paint baking conditions, as aging conditions. Under the conditions of a low temperature and a short holding time, in which a conventional paint-baking type steel sheet cannot be fully hardened, the steel sheet of the present invention can be stably and satisfactory hardened. In the present invention, a way to heat is not specifically limited, and in addition to atmospheric heating by a furnace which is generally used for paint baking, for example, induction heating, heating using nonoxidizing flame, laser, or plasma, and the like may be preferably used.

Strength of automobile parts must be strong enough to overcome external and complicated stresses imposed thereon, and hence, in a base steel sheet, strength properties in a large strain area are important in addition to those in a small strain area. In view of the point described above, the inventors of the present invention decided that the steel sheet of the present invention used as a base material for automobile parts had a BH amount of 80 MPa or more and had a ΔTS amount of 50 MPa or more. In order to further increase the BH amount and the ΔTS amount, the heating temperature for aging treatment may be increased, and/or the holding time may be prolonged.

In addition, the steel sheet of the present invention has new advantages, which could not be obtained in the past, in that aging degradation (a phenomenon in which YS is increased and El (elongation) is decreased) will not occur even when the steel sheet is held for a long time, approximately 1 year, at room temperature as long as the steel sheet is not pressed or machined.

The advantages of the present invention can be obtained even when the thickness of the finished product is relatively large; however, when the thickness of the finished product is more than 3.2 mm, a necessary and sufficient cooling rate cannot be ensured in annealing of a cold-rolled steel sheet, strain aging occurs during continuous annealing, and hence, desired strain age-hardening characteristics for the finished products are difficult to obtain. Accordingly, the thickness of the steel sheet of the present invention is preferably 3.2 mm or less.

In addition, in the present invention, electroplating or molten plating may be performed on the surface of the cold-rolled steel sheet of the present invention described above. These plated steel sheets have the TS, BH amount, and ΔTS amount equivalent to those obtained before plating. As the type of plating, electrolytic zinc plating, molten zinc plating, alloyed molten zinc plating, electrolytic tin plating, electrolytic chromium plating, electrolytic nickel plating, or the like may be preferably used.

Next, a method for manufacturing the steel sheet of the present invention will be described.

A thin steel sheet used in the present invention is a cold-rolled sheet having a predetermined thickness which is formed by steps of heating a slab having the composition described above, hot rolling the slab to form a hot-rolled steel sheet, and cold rolling the hot-rolled steel sheet. The temperature for heating the slab and rolling conditions of hot rolling and cold rolling are not specifically limited as long as a cold-rolled sheet having a predetermined thickness is obtained.

In the present invention, annealing treatment is performed using a continuous annealing line for a thin steel sheet which contains 0.05% to 0.30% of C, 0.4% to 2.0% of Si, 0.7% to 3.0% of Mn, 0.08% or less of P, 0.02% or less of Al, and 0.0050% to 0.0250% of N on a mass % basis, and in which the ratio N/Al is 0.3 or more.

The heating temperature of the annealing treatment is set to a temperature between (an $Ac_1$ transformation point) and (an $Ac_3$ transformation point+50° C.). In the present invention, in order to ensure a predetermined amount of residual γ in the final product, the heating temperature of the annealing treatment is preferably the $Ac_1$ transformation point or more. When the temperature is heated to the $Ac_1$ transformation point or more, phase separation occurs to form two phases of ferrite and austenite (γ), and after cooling, the residual γ is formed. In addition, when the heating temperature is more than the $Ac_3$ transformation point, phase separation occurs to form a ferrite and an austenite phase during cooling, and after cooling, the residual γ is formed. However, when the heating temperature is more than ($Ac_3$ transformation point +50° C.), crystal grains grow during annealing treatment, and the ductility is decreased. Accordingly, the heating temperature of the annealing treatment is preferably between (the $Ac_1$ transformation point) and (the $Ac_3$ transformation point+50° C.). The holding time at the heating temperature is not specifically limited; however, it is preferably set to 20 to 60 seconds.

Next, the steel sheet is processed by cooling treatment, that is, the steel sheet is quenched from the heating temperature to a temperature in the range of 350 to 500° C., in which the cooling is performed at a rate of 5 to 150° C./second in the range of at least 600 to 500° C.

When the cooling rate is less than 5° C./second, pearlite transformation occurs, the formation of residual γ is suppressed, and as a result, the ductility is decreased. On the other hand, when the cooling rate is more than 150° C./second, a large amount of C in a solid-solution state remains in the ferrite phase, and hence, the formation of the residual γ is suppressed. Accordingly, the cooling rate from the heating temperature to the temperature range of 350 to 500° C. is preferably set to 5 to 150° C./second. In addition, quenching as described above may be performed only in the range of at least 600 to 500° C. The reason for this is that the pearlite transformation becomes obvious in the temperature range of 600 to 500° C. In the present invention, in a region other than the temperature range of 600 to 500° C., the specification of the cooling rate thus described above is not required.

Next, holding treatment for holding the steel sheet in the temperature range of 350 to 500° C. for 30 seconds or more is performed. By this holding treatment in the temperature range of 350 to 500° C., a part of γ is transformed into bainite, and C is simultaneously concentrated in untransformed γ, thereby stabilizing the γ. As a result, after the temperature is decreased to room temperature, the austenite state is maintained, and hence, the residual γ is formed. Since this type of reaction significantly occurs in the range of 350 to 500° C., when the temperature of the holding treatment is more than 500° C., carbides are likely to be formed. Accordingly, the concentration of C in the austenite phase is not promoted, and the formation of the residual γ is prevented. On the other hand, when the temperature of the holding treatment is less than 350° C., the reaction described above takes a long period of time, and hence, a predetermined amount of the residual γ is not formed. In order to obtain a sufficient amount of residual γ, the time of the holding treatment is preferably set to 30 seconds or more. In addition, in order to stably ensure the residual γ, the time is more preferably set to 60 seconds or more. Furthermore, in view of the productivity, the time of the holding treatment is preferably set to 600 seconds or less. "Holding" in the present invention may include slow heating or slow cooling in the temperature range of 350 to 500° C.

EXAMPLES

Molten steels having the compositions shown in Table 1 were formed using a steel converter and were then formed into slabs by a continuous casting method. After heating these slabs to 1,150° C., hot rolling was performed, thereby forming hot-rolled sheets. In the above-mentioned step, the hot rolling finishing temperature was set in the range of 850 to 900° C. After these hot-rolled sheets were processed by pickling, cold rolling was performed, thereby forming cold-rolled sheets. Next, these cold-rolled sheets were processed in a continuous annealing line (CAL) by annealing treatment and cooling/holding treatment under the conditions shown in Table 2. In the above-mentioned steps, slow cooling (at a cooling rate of 1.5° C./second) was performed from the heating temperature for annealing to 680° C. and quenching was then performed from 680° C.

For the steel sheets thus obtained, the amount of solute N, microstructure, tensile characteristics, strain age-hardening characteristics were measured.

(1) Measurement of the Amount of Solute N

The amount of solute N was obtained by deducting the amount of precipitated N from the total amount of N in steel measured by a chemical analysis. The amount of precipitated N was obtained by an analytical method using a constant-potential electrolytic method described above.

(2) Microstructure

After specimens were prepared from the each annealed cold-rolled sheets, the microstructures of the cross-sections (C cross-sections) perpendicular to the rolling direction were photographed using an optical microscope or a scanning electron microscope, and the volume fraction of ferrite and bainite were then obtained using an image analyzer. In addition, the amount of residual γ was measured at a position ¼t thickness deep from the surface of the steel by using an x-ray diffraction method. The volume fraction of the residual γ was obtained by the ratios of intensities of (211) and (220) faces of γ to those of (200) and (220) of α.

(3) Tensile Properties

After specimens in accordance with JIS No.5 were prepared from the individual cold-rolled steel sheets in the rolling direction thereof, a tensile test was performed at a strain rate of $3\times10^{-3}$/second in accordance with JIS Z 2241, thereby obtaining the yield stress YS, the tensile strength TS, and the elongation El.

(4) Strain Age-Hardening Properties

After specimens in accordance with JIS No.5 were prepared from the individual cold-rolled steel sheets in the rolling direction, a 5%-tensile prestrain was applied to each specimen as predeformation, and heat treatment at 170° C. for 20 minutes, equivalent to the paint baking treatment, was then performed. Subsequently, a tensile test was performed at a strain rate of $3\times10^{-3}$/second, tensile characteristics (yield stress $YS_{BH}$ and tensile strength TS) after the predeformation and the paint baking treatment were obtained, and the amount of $BH=YS_{BH}-YS_{5\%}$, and $\Delta TS=TS_{BH}-TS$ were calculated. In the step described above, $YS_{5\%}$ was a deformation stress when a product sheet was predeformed by 5%, $YS_{BH}$ and $TS_{BH}$ were yield stress and tensile strength, respectively, after the predeformation and the paint baking treatment, and TS was the tensile strength of a product sheet.

These results are shown in Table 2.

In the examples of the present invention, the steel sheets were all formed so as to have superior ductility, strain age-hardening characteristics, and significantly high BH amount and ΔTS, whereby improvement in crash resistance properties of parts can be expected.

INDUSTRIAL APPLICABILITY

According to the present invention, a high tensile cold-rolled steel sheet can be stably manufactured having a BH amount of 80 MPa or more and a ΔTS of 50 MPa or more, which are obtained by predeformation and paint baking treatment, superior strain age-hardening characteristics, and superior formability, whereby this high tensile cold-rolled steel sheet can be advantageously used in various industrial fields. In addition, when the high tensile cold-rolled steel sheet of the present invention is applied to automobile parts, parts having stable and high crash resistance properties can be obtained having yield stress and tensile strength increased by the paint baking treatment or the like. Furthermore, since the thickness of a steel sheet to be used can be decreased from, for example, 2.0 to 1.6 mm, a steel sheet having a thickness smaller next to that used previously may be used, and the advantages in satisfactory reduction in weight of automobile body can also be obtained. In addition, by using the enhancement caused by the solute N, the content of another enhancing element such as Si, Mn, or the like can be reduced, and as a result, the effect of improving the weldability and paintability can also be obtained.

TABLE 1

| Steel | Chemical component (mass %) | | | | | | | | | | | | $Ac_1$ point | $Ac_3$ point |
|---|---|---|---|---|---|---|---|---|---|---|---|---|---|---|
| No. | C | Si | Mn | P | S | Al | N | N/Al | B, Cu, Ni, Cr | Ti, Nb, V, Zr | Total | Ca, REM | ° C. | ° C. |
| A | 0.12 | 1.1 | 1.3 | 0.01 | 0.005 | 0.005 | 0.010 | 2.0 | — | — | — | — | 725 | 835 |
| B | 0.12 | 1.0 | 1.4 | 0.01 | 0.005 | 0.011 | 0.011 | 1.0 | — | — | — | — | 725 | 820 |
| C | 0.12 | 1.3 | 1.2 | 0.01 | 0.005 | 0.014 | 0.003 | 0.21 | — | — | — | — | 725 | 840 |
| D | 0.12 | 1.3 | 1.2 | 0.01 | 0.005 | 0.020 | 0.015 | 0.75 | — | — | — | — | 725 | 840 |
| E | 0.12 | 1.2 | 1.2 | 0.01 | 0.005 | 0.031 | 0.006 | 0.19 | — | — | — | — | 725 | 840 |
| F | 0.17 | 1.4 | 1.6 | 0.01 | 0.005 | 0.014 | 0.012 | 0.85 | — | — | — | — | 725 | 810 |
| G | 0.17 | 1.5 | 1.6 | 0.01 | 0.005 | 0.013 | 0.003 | 0.23 | — | — | — | — | 725 | 815 |
| H | 0.11 | 0.9 | 1.4 | 0.01 | 0.005 | 0.013 | 0.010 | 0.77 | B: 0.0008 | — | — | — | 725 | 845 |
| I | 0.14 | 1.2 | 1.1 | 0.01 | 0.004 | 0.021 | 0.016 | 0.76 | Cu: 0.20, Ni: 0.10 | — | — | — | 725 | 820 |
| J | 0.10 | 1.1 | 1.6 | 0.01 | 0.005 | 0.006 | 0.011 | 1.50 | — | Ti: 0.003 | 0.003 | — | 725 | 850 |
| K | 0.15 | 1.2 | 1.7 | 0.01 | 0.004 | 0.010 | 0.009 | 0.90 | — | Ti: 0.004, Nb: 0.010 | 0.014 | — | 725 | 810 |
| L | 0.13 | 1.0 | 1.4 | 0.01 | 0.005 | 0.014 | 0.012 | 0.86 | Cr: 0.10 | V: 0.010, Zr: 0.010 | 0.020 | Ca: 0.0015 | 725 | 830 |

TABLE 2

| Steel | | Annealing treatment | | Cooling/Holding treatment | | | N in solid- | Steel sheet structure | | | |
|---|---|---|---|---|---|---|---|---|---|---|---|
| sheet No. | Steel No. | Heating temperature ° C. | Holding times | Cooling rate* ° C./s | Holding temperature ° C. | Holding times | solution state mass % | Ferrite Vol % | Bainite Vol % | Residualy Vol % | Others |
| 1 | A | 785 | 30 | 35 | 400 | 180 | 0.0070 | 48.8 | 43.1 | 8.1 | — |
| 2 | B | | | | | | 0.0056 | 43.0 | 43.0 | 9.0 | 5.0 |
| 3 | C | | | | | | 0.0008 | 55.0 | 35.1 | 6.9 | 3.0 |
| 4 | D | | | | | | 0.0051 | 50.5 | 41.4 | 8.1 | — |
| 5 | E | | | | | | 0.0004 | 39.0 | 53.1 | 7.9 | — |
| 6 | F | | | | | | 0.0049 | 38.2 | 49.5 | 12.3 | — |
| 7 | G | | | | | | 0.0007 | 44.8 | 43.4 | 11.8 | — |
| 8 | D | 715 | 30 | 40 | 380 | 240 | 0.0052 | 75.2 | — | — | 24.8 |
| 9 | D | 880 | | 50 | 415 | 210 | 0.0050 | 30.3 | 59.0 | 7.7 | 3.0 |
| 10 | D | 910 | | 45 | 395 | 180 | 0.0046 | 18.2 | 49.5 | 4.3 | 28.0 |
| 11 | D | 790 | | 3 | 400 | 180 | 0.0048 | 48.5 | 39.0 | 1.5 | 11.0 |
| 12 | D | 790 | | 160 | 415 | 205 | 0.0052 | 50.0 | 43.1 | 1.9 | 5.0 |
| 13 | D | 755 | | 55 | 510 | 180 | 0.0047 | 47.3 | 38.7 | 2.0 | 12.0 |
| 14 | D | 770 | | 45 | 330 | 170 | 0.0046 | 43.5 | 27.9 | 2.7 | 25.9 |
| 15 | D | 770 | | 30 | 420 | 20 | 0.0053 | 44.0 | 29.5 | 1.5 | 25.0 |
| 16 | H | 785 | 30 | 35 | 400 | 180 | 0.0039 | 52.3 | 33.8 | 6.6 | 7.3 |

TABLE 2-continued

| | | | | | | | | |
|---|---|---|---|---|---|---|---|---|
| 17 | I | 0.0053 | 49.3 | 37.5 | 7.2 | 6.0 |
| 18 | J | 0.0055 | 45.7 | 46.2 | 8.1 | — |
| 19 | K | 0.0051 | 44.3 | 49.7 | 6.0 | — |
| 20 | L | 0.0045 | 51.2 | 41.3 | 7.5 | — |

| Steel | | Tensile characteristics | | | Tensile characteristics after strain aging | | Strain age-hardening characteristics | | |
|---|---|---|---|---|---|---|---|---|---|
| sheet No. | Steel No. | YS (MPa) | TS (MPa) | EI (%) | YS (MPa) | TS (MPa) | BH amount (MPa) | ΔTS (MPa) | Remarks |
| 1 | A | 455 | 680 | 36 | 673 | 761 | 95 | 81 | Example |
| 2 | B | 430 | 670 | 37 | 647 | 745 | 82 | 75 | Example |
| 3 | C | 460 | 710 | 35 | 605 | 730 | 25 | 20 | Comparative example |
| 4 | D | 450 | 690 | 37 | 677 | 745 | 87 | 55 | Example |
| 5 | E | 440 | 680 | 37 | 590 | 690 | 17 | 10 | Comparative example |
| 6 | F | 510 | 820 | 32 | 760 | 880 | 95 | 60 | Example |
| 7 | G | 505 | 830 | 31 | 695 | 845 | 21 | 15 | Comparative example |
| 8 | D | 470 | 515 | 24 | 510 | 576 | 66 | 60 | Comparative example |
| 9 | D | 485 | 715 | 35 | 725 | 785 | 95 | 70 | Example |
| 10 | D | 440 | 375 | 31 | 520 | 440 | 35 | 65 | Comparative example |
| 11 | D | 460 | 545 | 26 | 580 | 605 | 45 | 60 | Comparative example |
| 12 | D | 505 | 720 | 28 | 700 | 780 | 50 | 60 | Comparative example |
| 13 | D | 380 | 490 | 25 | 520 | 555 | 40 | 65 | Comparative example |
| 14 | D | 360 | 625 | 26 | 530 | 690 | 42 | 65 | Comparative example |
| 15 | D | 350 | 670 | 24 | 510 | 740 | 40 | 70 | Comparative example |
| 16 | H | 410 | 705 | 35 | 681 | 775 | 98 | 70 | Example |
| 17 | I | 430 | 725 | 35 | 700 | 800 | 105 | 75 | Example |
| 18 | J | 385 | 610 | 37 | 632 | 693 | 112 | 83 | Example |
| 19 | K | 420 | 690 | 36 | 674 | 758 | 94 | 68 | Example |
| 20 | L | 425 | 700 | 35 | 658 | 772 | 98 | 72 | Example |

*Average cooling rate from 680° C. to holding temperature

What is claimed is:

1. A high tensile cold-rolled steel sheet which has superior ductility and strain age-hardening characteristics having a ΔTS of 50 MPa or more, having a composition comprising, on a mass % basis, 0.05% to 0.30% of C, 0.4% to 2.0% of Si, 0.7% to 3.0% of Mn, 0.08% or less of P, 0.02% or less of Al, and 0.0050% to 0.0250% of N, wherein N/Al is 0.3 or more, 0.0010% or more of N in a solid-solution state is contained, and the balance is Fe and unavoidable impurities, and the high tensile cold-rolled steel sheet has a composite structure comprising 20% to 80% of a ferrite phase, 10% to 60% of a bainite phase, and 3.0% or more of a residual austenite phase.

2. A high tensile cold-rolled steel sheet according to claim 1, in addition to the composition, further comprising at least one of a to c groups on a mass % basis, in which the a group contains at least one of 0.0003% to 0.01% of B, 0.005% to 1.5% of Cu, 0.005% to 1.5% of Ni, and 0.05% to 1.0% of Cr, the b group contains at least one of Ti, Nb, V, and Zr at a total content of 0.002% to 0.03%, and the c group contains at least one of Ca and REM at a total content of 0.0010% to 0.010%.

3. A high tensile cold-rolled steel sheet according to claim 1, wherein the high tensile cold-rolled steel sheet has a thickness of 3.2 mm or less.

4. A method for manufacturing a high tensile cold-rolled steel sheet which has superior ductility and strain age-hardening characteristics having a ΔTS of 50 MPa or more, the method comprising an annealing step of annealing a thin cold-rolled steel sheet containing, on a mass % basis, 0.05% to 0.30% of C, 0.4% to 2.0% of Si, 0.7% to 3.0% of Mn, 0.08% or less of P, 0.02% or less of Al, and 0.0050% to 0.0250% of N, wherein N/Al is 0.3 or more, at a heating temperature between (an $Ac_1$ transformation point) and (an $Ac_3$ transformation point+50° C.); and a cooling/holding step for cooling the steel sheet from the heating temperature at a cooling rate of 5 to 150° C./second in the range of at least 600 to 500° C., and holding the steel sheet for 30 seconds or more in the temperature range of 350 to 500° C.

5. A high tensile cold-rolled steel sheet according to claim 2, wherein the high tensile cold-rolled steel sheet has a thickness of 3.2 mm or less.

* * * * *

UNITED STATES PATENT AND TRADEMARK OFFICE

CERTIFICATE OF CORRECTION

PATENT NO. : 6,692,584 B2
DATED : February 17, 2004
INVENTOR(S) : Sakata et al.

It is certified that error appears in the above-identified patent and that said Letters Patent is hereby corrected as shown below:

Column 16,
Table 2, at the subheading "TS (MPa)" (second occurrence), please change "576" to -- 575 --.

Signed and Sealed this

Fifth Day of October, 2004

JON W. DUDAS
*Director of the United States Patent and Trademark Office*